US006144310A

United States Patent [19]

Morris

[11] Patent Number: 6,144,310

[45] Date of Patent: Nov. 7, 2000

[54] ENVIRONMENTAL CONDITION DETECTOR WITH AUDIBLE ALARM AND VOICE IDENTIFIER

[76] Inventor: Gary Jay Morris, 2026 Glenmark Ave., Morgantown, W. Va. 26505

[21] Appl. No.: 09/299,483

[22] Filed: Apr. 26, 1999

Related U.S. Application Data

[60] Provisional application No. 60/117,307, Jan. 26, 1999.

[51] Int. Cl.[7] ..... G08B 25/08

[52] U.S. Cl. ..... 340/692; 340/505; 340/506; 340/539; 340/577; 340/628; 340/632; 340/693.11

[58] Field of Search ..... 340/692, 500, 340/505, 506, 517, 520, 521, 522, 523, 524, 531, 532, 533, 534, 539, 540, 577, 584, 605, 628, 632, 691.1, 691.4, 693.5, 693.6, 693.7, 693.9, 693.11, 286.01, 286.05, 286.11, 328, 329, 386.1, 384.3, 384.4–384.73

[56] References Cited

U.S. PATENT DOCUMENTS

| | | | |
|---|---|---|---|
| 4,160,246 | 7/1979 | Martin et al. . | |
| 4,275,274 | 6/1981 | English . | |
| 4,282,519 | 8/1981 | Hagland et al. . | |
| 4,288,789 | 9/1981 | Molinick et al. | 340/524 |
| 4,335,379 | 6/1982 | Martin . | |
| 4,343,990 | 8/1982 | Ueda . | |
| 4,350,860 | 9/1982 | Ueda . | |
| 4,351,999 | 9/1982 | Nagamoto et al. . | |
| 4,531,114 | 7/1985 | Topol et al. . | |
| 4,688,021 | 8/1987 | Buck et al. . | |
| 4,698,619 | 10/1987 | Loeb | 340/384.1 |
| 4,754,266 | 6/1988 | Shand et al. . | |
| 4,816,809 | 3/1989 | Kim . | |
| 4,862,147 | 8/1989 | Thomas | 340/628 |
| 4,951,045 | 8/1990 | Knapp et al. | 340/944 |
| 5,229,753 | 7/1993 | Berg et al. . | |
| 5,291,183 | 3/1994 | Chiang . | |
| 5,349,338 | 9/1994 | Routman et al. . | |
| 5,379,028 | 1/1995 | Chung . | |
| 5,460,228 | 10/1995 | Butler . | |
| 5,587,705 | 12/1996 | Morris . | |
| 5,657,380 | 8/1997 | Mozer . | |
| 5,663,714 | 9/1997 | Fray . | |
| 5,673,023 | 9/1997 | Smith . | |
| 5,724,020 | 3/1998 | Hsu . | |
| 5,726,629 | 3/1998 | Yu . | |
| 5,764,134 | 6/1998 | Carr et al. . | |

(List continued on next page.)

OTHER PUBLICATIONS

NFPA 72 National Fire Alarm Code 1996 Edition, 72–1to 72–106 (partial copy).

NFPA 72, Recommended Practice for the Installation of Household Carbon Monoxide (CO) Warning Equipment 1998 Edition;.

UL 217 ISBN 0–7629–0062–8, Single and Multiple Station Smoke Alarms, Mar. 16, 1998–Feb. 21, 1997.

UL 2034 ISBN 0–7629–274–9, Single and Multiple Station Carbon Monoxide Alarms, Dec. 21, 1998–Oct. 29, 1996.

National Fire Protection Association–NFPA72–National Fire Alarm Code 1996 Edition pp. 72–105 through 72–106. Quincy, MA USA.

*Primary Examiner*—Nina Tong

*Attorney, Agent, or Firm*—Rockey, Milnamow & Katz, Ltd.

[57] ABSTRACT

Due to the presence of various environmental condition detectors in the home and businesses such as smoke detectors, carbon monoxide detectors, natural gas detectors, etc., each having individual but similar sounding alarm patterns, it can be difficult for occupants of such dwellings to immediately determine the specific type of environmental condition that exists during an alarm condition. The present invention comprises an environmental condition detector using both tonal pattern alarms and pre-recorded voice messages to indicate information about the environmental condition being sensed. Single-station battery-powered and 120 VAC detectors are described as are multiple-station interconnected 120 VAC powered detectors. The pre-recorded voice messages describe the type of environmental condition detected or the location of the environmental condition detector sensing the condition, or both, in addition to the tonal pattern alarm. Provisions are made for multi-lingual pre-recorded voice messages.

22 Claims, 5 Drawing Sheets

U.S. PATENT DOCUMENTS 5,786,749 7/1998 Johnson et al. .
5,786,768 7/1998 Chan et al. .
5,798,686 8/1998 Schreiner .
5,841,347 11/1998 Kim .
5,846,089 12/1998 Weiss et al. .
5,856,781 1/1999 Michel et al. .
5,864,288 1/1999 Hogan .
5,874,893 2/1999 Ford .
5,877,698 3/1999 Kusnier et al. .
5,886,631 3/1999 Ralph .
5,894,275 4/1999 Swingle .
5,905,438 5/1999 Weiss et al. ..... 340/636
5,914,650 6/1999 Segan .
5,936,515 8/1999 Right et al. .
6,043,750 3/2000 Mallory .

ENVIRONMENTAL CONDITION DETECTOR WITH AUDIBLE ALARM AND VOICE IDENTIFIER

This application is in reference to Provisional Patent Application No. 60/117,307 filed Jan. 26, 1999.

BACKGROUND FOR THE INVENTION

1. Field of Invention

The present invention relates to environmental condition detection for dwellings including smoke detection, carbon monoxide gas detection, natural gas detection, propane gas detection, combination smoke and carbon monoxide gas detection, etc. such that the audible tonal pattern alarm emitted by a detector sensing an abnormal environmental condition is accompanied by a pre-recorded voice message that clearly indicates the specific type of condition sensed or the specific location of the detector sensing the condition, or both.

2. Background

With the widespread use of environmental condition detectors such as smoke detectors, carbon monoxide detectors, natural gas detectors, propane detectors, etc. in residences and businesses today, there is a critical need to provide definite distinction between the tonal pattern alarms emitted by each type of detector so that the occupants of the involved dwelling are immediately made aware of the specific type of condition detected along with its location so they can take the proper immediate action. Regulating and governing bodies for products of the home safety industry (National Fire Protection Association, Underwriters Laboratories, etc.) have recently regulated the tonal patterns emitted from such environmental detectors, however, much confusion still exists among the very similar tonal pattern alarms emitted by various detector types. This is particularly true for those individuals partially overcome by the environmental condition, those asleep when the alarm occurs, young children, or the elderly. Therefore, a need exists whereby the environmental detector sensing an abnormal condition plays a recorded voice message stating the specific condition and/or location of the condition in addition to the required tonal pattern alarm. In conventional smoke detectors and carbon monoxide detectors, there are silent periods within the prescribed audible tonal pattern alarms where recorded verbal messages such as "smoke" or "CO" or "carbon monoxide" or "smoke in basement" or "utility room" (as examples) may be played during this alarm silence period to clearly discriminate between the types of audible alarms and environmental conditions and where the environmental condition was detected. Such messages immediately provide the occupants in an involved dwelling important safety information during potentially hazardous environmental conditions. The occupants can make informed decisions about how to respond to the alarm condition. Occupants residing in the uninvolved area of the dwelling may choose to assist those residing in the involved area depending on the location and type of condition detected. The type of environmental condition sensed or the location of the condition, or both are immediately made clear through the use of recorded voice messages in addition to conventional tonal pattern alarms.

3. Discussion of Prior Art

While there are inventions in the prior art pertaining to emergency alarm systems utilizing verbal instructions, none are known to the inventor which use a combination of tonal pattern alarms and factory pre-recorded voice messages with function or intent to clearly and specifically identify and clarify which type of environmental condition is present in a dwelling. Nor are there known inventions that use such pre-recorded voice messages to specifically identify the location of the environmental condition sensed by environmental condition detectors in dwellings without the use of a central control unit.

Morris (U.S. Pat. No. 5,587,705) describes a wireless smoke detector system using a minimum of two smoke detectors to indicate the location of the smoke detector sensing the smoke through coded alarm patterns. The present invention does not use wireless communication between detectors; each detector may operate without any others or may operate as a hardwired system with interconnected units for those powered by 120 VAC. Fray (U.S. Pat No. 5,663,714) describes a warning system for giving user-recorded verbal instructions during a fire. Fray teaches an object of his invention is to warn individuals of the presence of smoke and fire and to provide verbal instructions and guidance as how to escape the hazard. Routman et al (U.S. Pat. No. 5,349,338) describe a fire detector and alarm system that uses personally familiar user-recorded verbal messages specifically for a small child or adult in need of verbal instructions during the presence of a fire. Chiang (U.S. Pat. No. 5,291,183) describes a multi-functional alarming system using a microphone to sense ambient conditions and user-recorded verbal instructions for indicating the way to escape a fire. Kim (U.S. Pat. No. 4,816,809) describes a speaking fire alarm system that uses a central control system with remote temperature sensors. Haglund et al (U.S. Pat. No. 4,282,519) describe a hardwired smoke detector system whereby two audible alarm codes are indicated to determine whether the smoke was detected locally or not. Only two possible alarm patterns are used and no voice message is used with Haglund's hardwired system. Molinick and Sheilds (U.S. Pat. No. 4,288,789) describe an oral warning system for monitoring mining operations that uses a plurality of non-emergency condition sensors and second sensors for detecting emergencies. The patent further describes the use of a single and system-central multiple-track magnetic tape player for storing the verbal messages and links the alarm system to control the operation of mechanical devices (mining conveyor belts, etc.) during emergency conditions when verbal messages are played.

Additionally, Morris (U.S. Pat. No. 5,587,705), Fray (U.S. Pat. No. 5,663,714), Routman et al (U.S. Pat. No. 5,349,338), Chaing (U.S. Pat. No. 5,291,183), Kim (U.S. Pat. No. 4,816,809), and Haglund et al (U.S. Pat. No. 4,282,519) do not recite the specific use of factory pre-recorded voice messages to indicate the specific location of the environmental condition, or the use of voice messages to identify the specific type of environmental condition detected, or the use of a plurality of interconnected detectors emitting identical verbal messages, or a selectable means to define the installation location of the detector, all of which are taught in the present invention and afford significant safety advantages. While Molinick and Shields (U.S. Pat. No. 4,288,789) refer to verbally describing an emergency condition in mining operations, their patent teaches of a much more complex system than the present invention and describes a central control system with multiple stages of various configuration sensors and the use of user-recorded voice messages. Furthermore, the patent does not describe a selectable coding means to define the installation location of the sensors.

All known prior art providing user-recorded verbal instructions on how to escape a hazardous condition has become impractical for use in dwellings in view of the recent National Fire Protection Association (NFPA) and Underwriters Laboratories (UL,) regulations that require a maximum silence period between tonal alarm patterns of 1.5 seconds (Ref UL2034, UL217, NFPA72 and NFPA720). This period of time is sufficient for the present invention to verbally indicate the type and location of the sensed environmental condition but is unlikely to be useful to provide detailed instructions, as taught in the prior art, to occupants on how to respond to a hazardous condition.

The present invention employs either single station environmental condition detectors or a system comprising direct, hardwired communication links between a plurality of environmental condition detectors to provide a tonal pattern alarm with pre-recorded voice message information regarding the specific type of environmental condition detected or the specific location of the detector sensing the environmental condition, or both, all without the need of a centralized control unit. For detector embodiments using pre-recorded voice messages to indicate the location of the detected condition, each detector is set-up by the user during installation to define the physical location of the detector within the dwelling according to pre-defined location definitions pre-programmed into the electronic storage media. The recorded voice messages are pre-recorded into the electronic storage media during manufacture and are not normally changeable by the user. In view of the recent National Fire Protection Association and Underwriters Laboratories regulations for tonal pattern alarms, it is not practical to have the user record their own sounds during the silent periods of the tonal pattern. The user may choose to record other alarm sounds that would violate the regulations governing such tonal patterns and compromise the safety features of the device. The use of factory pre-recorded voice messages alleviates this problem.

It is emphasized that no other related prior art known to the inventor makes use of factory pre-recorded voice messages to indicate the location of the environmental condition or the type of condition or both. Sufficient addressable electronic memory is available in the preferred embodiment of the invention to afford numerous pre-recorded voice messages.

SUMMARY OF THE INVENTION

Described herein is the Environmental Condition Detector with Audible Alarm and Voice Identifier invention, which comprises an environmental condition detector, such as a smoke detector, carbon monoxide gas detector, natural gas detector, propane detector, or any combination detector thereof, which detects the desired environmental condition (s) by those methods well known and described in the art and emits the prescribed audible tonal pattern alarm in accordance with the industry's empowered governing bodies' (National Fire Protection Association, Underwriters Laboratories etc.) criteria for such environmental conditions. Simultaneously, the environmental condition detector sensing the condition emits a verbal message to indicate, through a recorded voice message or synthesized human voice, the condition being sensed. This recorded voice message is emitted simultaneously with the audible tonal pattern alarm so as normally to occur during silent segments of the prescribed tonal pattern alarm. For example, for the condition of smoke detection, the smoke detector emits the following combination audible tonal pattern alarm (Beep) and recorded voice message, "Beep - - - Beep - - - Beep - - - 'SMOKE' - - - Beep - - - Beep - - - Beep - - - 'SMOKE' - - - " in a periodic manner for as long as the environmental condition is detected. As a second example, for carbon monoxide detection, a carbon monoxide detector emits "Beep - - - Beep - - - Beep - - - Beep - - - 'CO' - - - Beep - - - Beep - - - Beep - - - Beep - - - 'CO' - - - ". As a third example, for smoke detection with the location identifier, a smoke detector emits "Beep - - - Beep - - - Beep - - - "SMOKE IN BASEMENT' - - - Beep - - - Beep - - - Beep - - - 'SMOKE IN BASEMENT' - - - ". As a fourth example, for carbon monoxide detection with a voice location only identifier, a carbon monoxide detector emits "Beep - - - Beep - - - Beep - - - Beep - - - 'Utility Room' - - - Beep - - - Beep - - - Beep - - - Beep - - - 'Utility Room' - - - ".

OBJECTS AND ADVANTAGES OF THE PRESENT INVENTION

It is one object of the present invention to provide environmental condition detectors that function as single station (non-interconnected) detector units equipped to emit a tonal pattern alarm and a recorded voice message. The recorded voice message clearly identifies the location of the environmental condition detector sensing the condition, or describes the type of environmental condition that has been detected, or both, as illustrated in the above, non-exhaustive examples. The single station detector embodiment is battery powered or 120 VAC powered. User-selectable coding switches or jumpers permit the user to define the physical location of the single station unit within the dwelling. No other related prior art is known to the inventor that uses factory pre-recorded voice messages in combination with conventional tonal pattern alarms to indicate the specific type or specific location, or both, of an abnormal environmental condition as related to single station units.

It is another object of the present invention to provide an environmental condition detection system where one detector sensing an environmental condition causes all other interconnected detectors to emit identical tonal pattern alarms and recorded voice messages. The hardwired, directly interconnected detectors forming the environmental condition detection system are 120 VAC powered with optional battery back-up and use the recorded voice message to identify the location of the environmental condition detector sensing the condition, or to describe the type of environmental condition that has been detected, or both, as illustrated in the above, non-exhaustive examples. The environmental condition detection system embodiments of the present invention do not require the use of a centralized control unit (control panel) between detectors. No other related prior art is known to the inventor that uses factory pre-recorded voice messages in combination with conventional tonal pattern alarms to indicate the specific type or specific location, or both, of an abnormal environmental condition as related to a directly interconnected environmental condition detector system having no central control unit or panel.

A major advantage of both the single station embodiment and the system embodiment of the present invention is the use of factory pre-recorded voice messages that fit within the National Fire Protection Association and Underwriters Laboratories specified 1.5 second silence period of the standard smoke detector and carbon monoxide detector tonal pattern alarms. Prior art using user-recorded voice messages are intended to indicate directions on how to escape the hazard or how to respond to a hazard. Such messages would not practically fit into the maximum 1.5 second silent time period in conventional tonal alarm patterns for smoke detectors and carbon monoxide detectors used in dwellings. The allowance for a user to record his or her own messages may actually add to the confusion and danger that results during an alarm condition if the user chooses to record additional alarm sounds or errs in the directions given in the message on how to properly respond to a hazardous conditon.

DETAILED DESCRIPTION OF THE INVENTION

Figure 1:
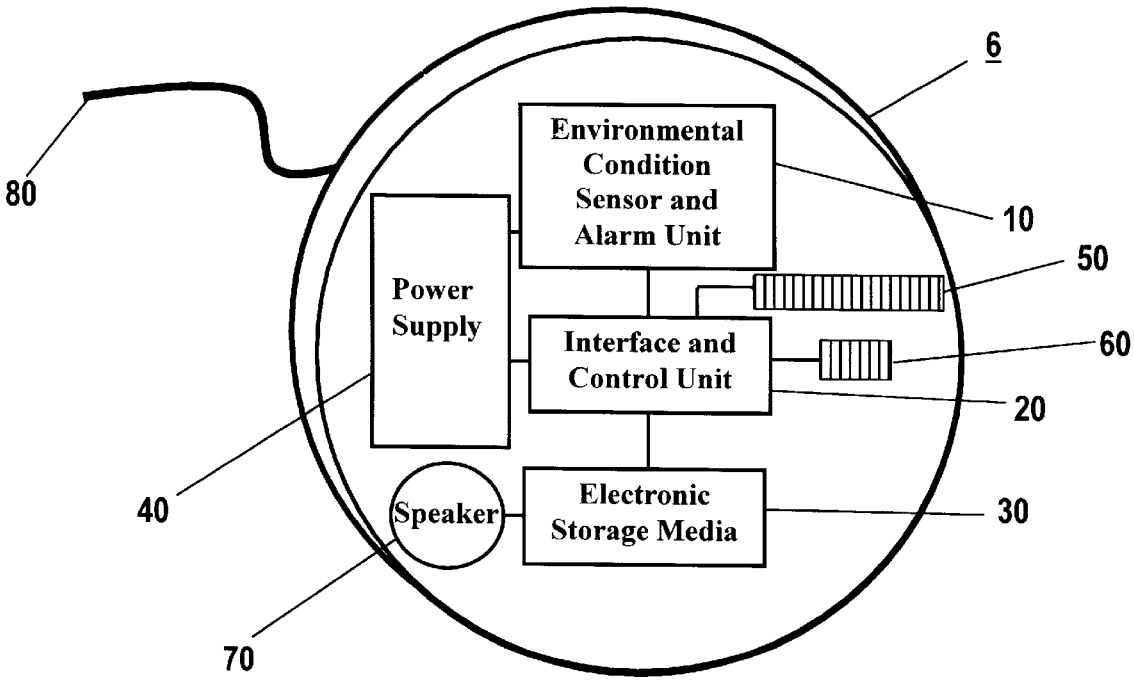
FIG. 1 is a sketch of a preferred embodiment of the Environmental Condition Detector with Alarm and Voice Identifier according to the invention.

A preferred embodiment of the Environmental Condition Detector with Alarm and Voice Identifier 6 is shown in FIG. 1. The unit is powered by a battery 40 and/or by standard 120 VAC (not shown). The environmental condition sensor and alarm unit 10 (conventional smoke detector, carbon monoxide detector, combination smoke detector and carbon monoxide detector, natural gas detector, propane detector, abnormal temperature etc.) is any sensor type(s) utilizing environmental detection methods and alarm devices typically known in the art of smoke detectors, carbon monoxide detectors and other hazard detectors. Upon sensing the environmental condition, the environmental condition sensor and alarm unit 10 sounds its tonal pattern alarm to indicate that an environmental condition has been sensed in the immediate area. The alarm pattern is a prescribed audible tonal pattern alarm corresponding to the environmental condition as set forth by the empowered governing body (National Fire Protection Association, Underwriters Laboratories etc.). The interface and control unit 20 electronically interfaces with the environmental condition sensor and alarm unit 10 and controls the timing of a recorded voice message that is emitted simultaneously with the audible tonal pattern alarm such that the recorded voice message is emitted only during the period when the audible tonal pattern alarm cycles through a silent period. In one embodiment, an electronic signal frequency counter (not shown) is used to determine when the silent period of the audible alarm is occurring. The recorded voice message or synthesized human voice message is factory-recorded on an electronic storage media 30 such as, but not limited to, a ROM device. The recorded voice message is emitted through a speaker or other audio transducer 70. For the embodiments of the invention requiring identification of the location of the environmental condition detector sensing the environmental condition, a selectable coding apparatus 50 (jumper selector or DIP switch) which connects to the interface and control unit 20 is provided to select one of several predefined physical locations of the environmental condition detectors within a residence. Recorded voice messages to identify physical locations consistent with the position of the selectable coding apparatus 50 are stored on the electronic storage media 30. The selectable coding apparatus 50 is set to correspond to the location within the dwelling where the particular environmental condition detector 6 is installed. A language code selector (jumper set or DIP switch) 60 is used to choose the language type (English, Spanish, etc.) used by the recorded voice. For interconnected 120 VAC units, when one environmental condition detector sounds its tonal pattern alarm and recorded voice message, all interconnected units will sound identical tonal pattern alarms and recorded voice messages in temporal phase. For the environmental condition detection system embodiment, an interconnecting, conductor set 80 sends and receives a coded electrical signal encoded and decoded by the interface and control unit 20 by the sending and receiving detector, respectively. The coding of the signal sent over the interconnecting conductor set determines what specific recorded voice message is played from the electronic storage media 30 at the interconnected but remotely located environmental condition detectors. Another embodiment of the invention shown in FIG. 3 uses several interconnection conductors which alleviates the need for electrical encoding and decoding of the signal sent and received over the interconnecting conductor set 80.

Figure 2:
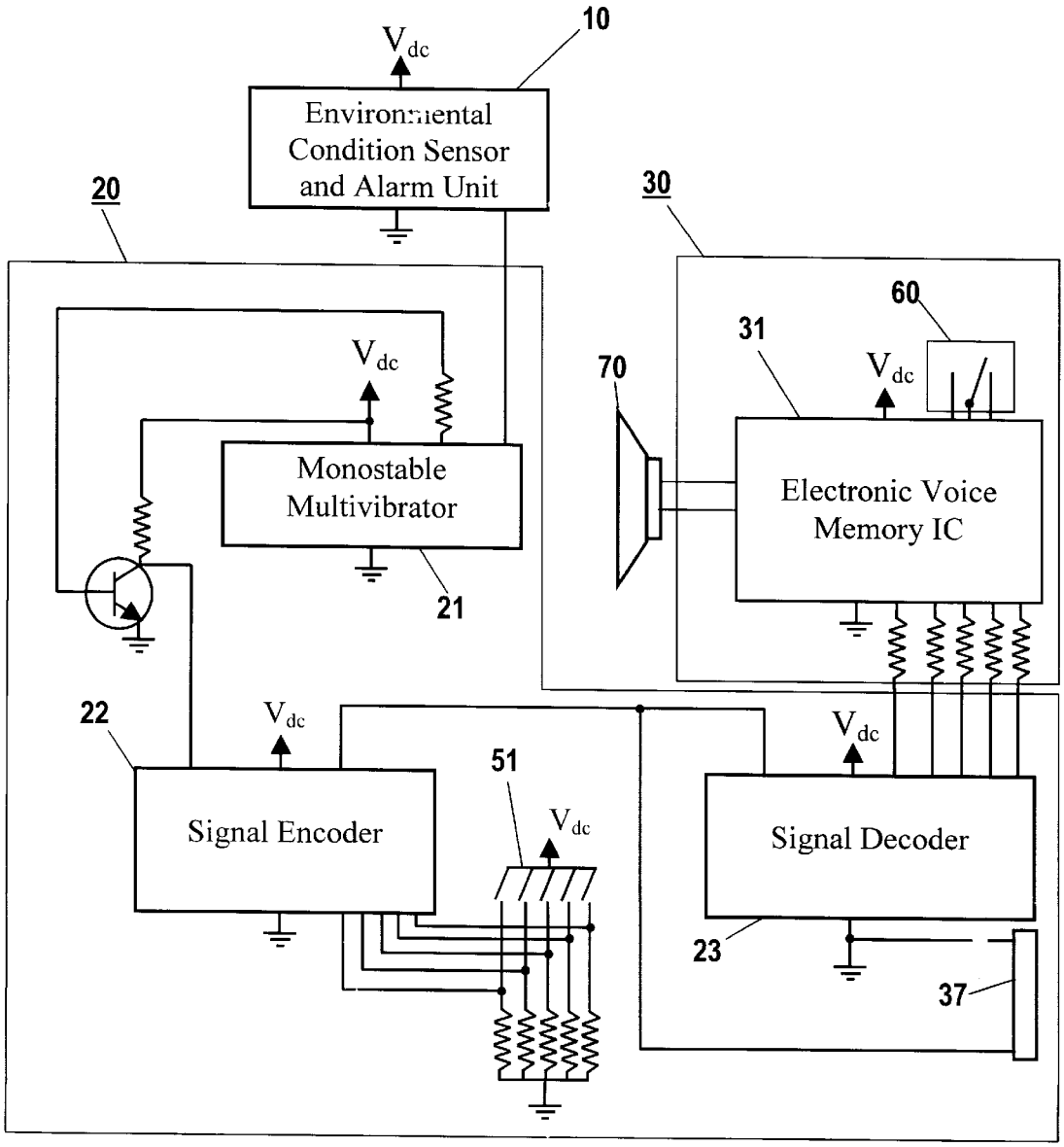
FIG. 2 is a sketch of a preferred embodiment of the electronic circuitry for the interconnected system embodiment of the Environmental Condition Detector with Alarm and Voice Identifier according to the invention.

Shown in FIG. 2 is a sketch of a preferred embodiment of the electronic circuitry for one detector unit of the interconnected system embodiment of the Environmental Condition Detector with Alarm and Voice Identifier. The environmental condition sensor and alarm unit 10 connects to the interface and control unit 20 to trigger the monostable multivibrator 21 for a predetermined period of time when an environmental condition is detected. The monostable multivibrator 21 enables the signal encoder 22 to send a coded electrical signal to the local signal decoder 23 and to all other signal decoders of interconnected detectors hardwired linked together through the conductor set 80 shown in FIG. 1. Upon receiving a local or remote encoded signal, the signal decoder 23 decodes the signal and validates or rejects the signal. Upon validation of a received signal, within each interconnected detector, the signal decoder 23 enables and addresses the electronic voice memory integrated circuit 31 to emit a recorded voice message verbally describing the location or type, or both, of the environmental condition sensed. All recorded voice messages emitted by the interconnected detector units connected through the conductor set 80 via electrical conductor connector 37 are in temporal phase. A selectable coding apparatus of switches or jumpers 51 defines the physical installation location of each environmental condition detector through pre-defined location designations illustrated in FIG. 7. A language selector switch apparatus 60 is used to select which language is used during the playing of the recorded voice messages. The recorded voice message is played through a speaker 70.

Figure 3:
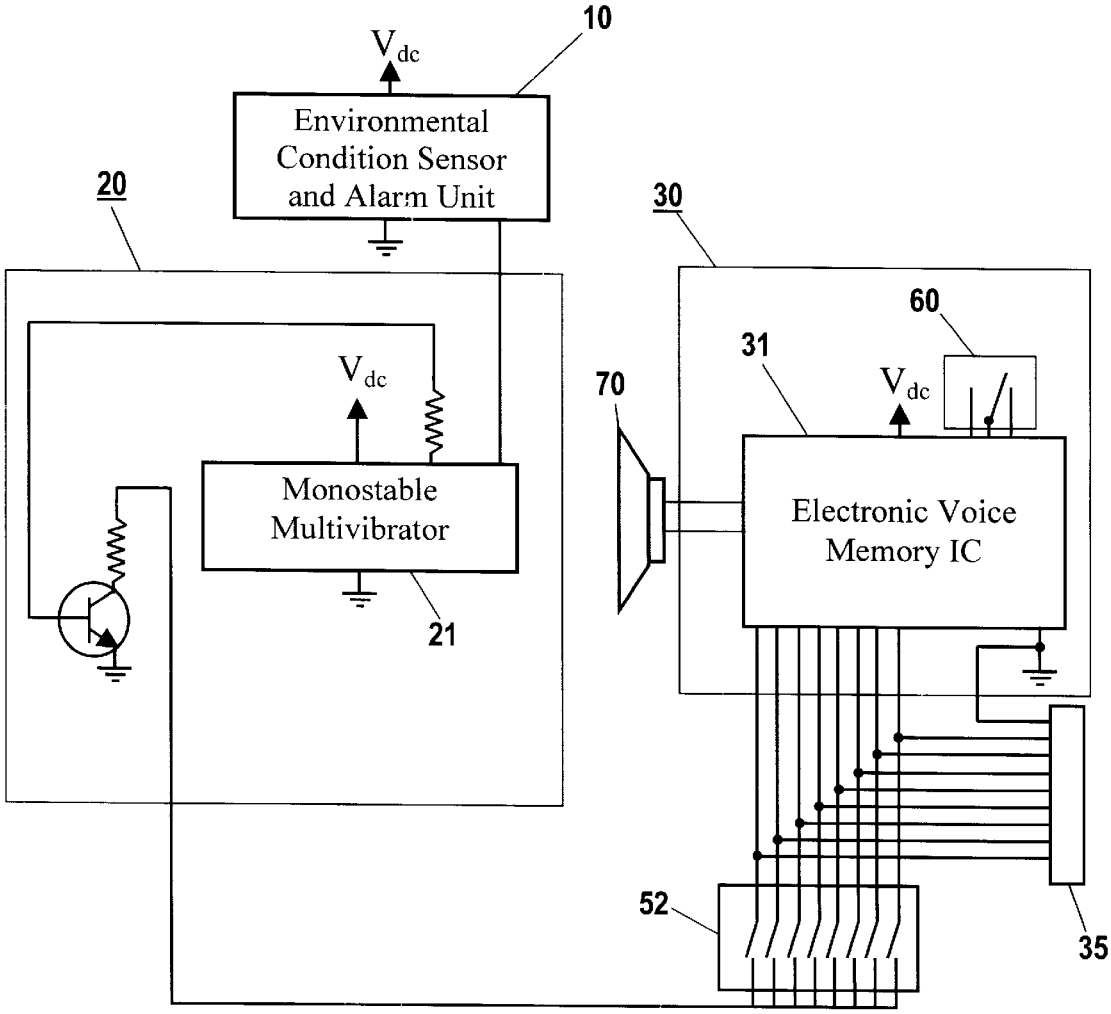
FIG. 3 is a sketch of a second preferred embodiment of the electronic circuitry for the interconnected system embodiment of the Environmental Condition Detector with Alarm and Voice Identifier according to the invention.

Shown in FIG. 3 is a sketch of a second preferred embodiment of the electronic circuitry for one detector unit for the interconnected system embodiment of the Environmental Condition Detector with Alarm and Voice Identifier. The environmental condition sensor and alarm unit 10 connects to the interface and control unit 20 to trigger the monostable multivibrator 21 for a predetermined period of time when an environmental condition is detected. The monostable multivibrator 21 enables the electronic voice memory integrated circuit 31 to emit a recorded voice message verbally describing the location or type, or both, of the environmental condition sensed. All detector units within the interconnected system share common electrical connection to the address bits on each detector unit's electronic voice memory integrated circuit 31 through a multiple conductor connector interface 35 which results in all detector units emitting identical recorded voice messages in temporal phase. A selectable coding apparatus of switches or jumpers 52 defines the physical installation location of each environmental condition detector through pre-defined location designations illustrated in FIG. 7. A language selector switch apparatus 60 is used to select which language is used during the playing of the recorded voice messages. The recorded voice message is played through a speaker 70.

Figure 4:
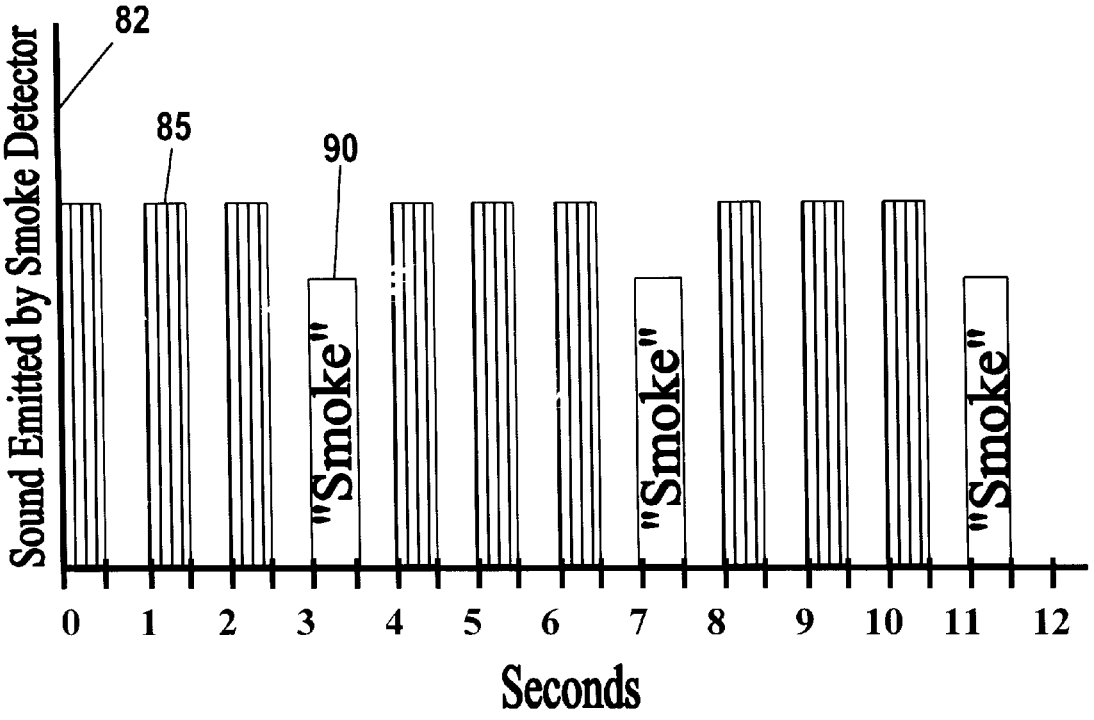
FIG. 4 shows an example audible tonal pattern alarm and recorded voice message combination used for the Environmental Condition Detector with Alarm and Voice Identifier configured as a smoke detector and using a recorded voice message as an environmental condition type identifier according to the invention.

Shown in FIG. 4 is an example alarm timing plot of the sound emitted 82 by an environmental condition detector using both an audible tonal pattern alarm 85 and a recorded voice message 90 to convey information about the specific environmental condition detected. In the example exhibited in FIG. 2, the environmental condition detector embodiment is a smoke detector using voice as an environmental condition type identifier only. The recorded voice message 90 is inserted into the defined silence periods of the prescribed audible tonal pattern alarm 85 consistent with conventional smoke detector alarms.

Figure 5:
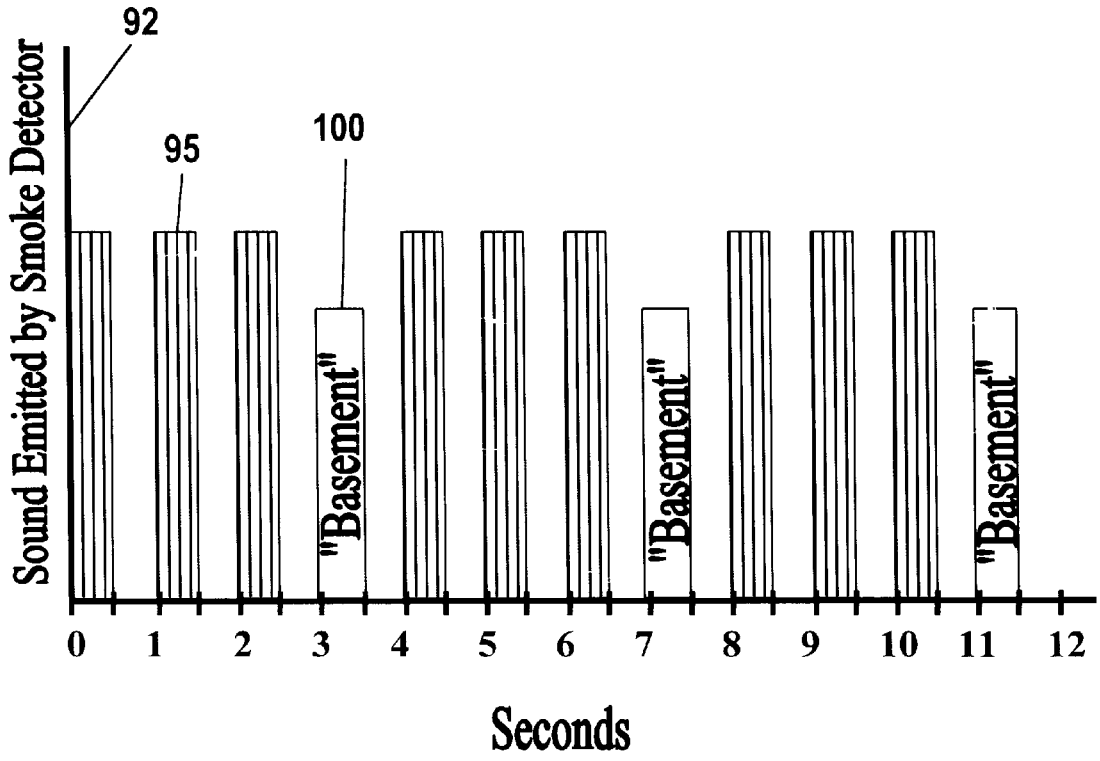
FIG. 5 shows an example audible tonal pattern alarm and recorded voice message combination used for the Environmental Condition Detector with Alarm and Voice Identifier configured as a smoke detector using a recorded voice message as an environmental condition location identifier according to the invention.

Shown in FIG. 5 is an example alarm timing plot of the sound emitted 92 by an environmental condition detector using an audible tonal pattern alarm 95 to convey the specific type of environmental condition and a recorded voice message 100 to convey the location of the detected environmental condition. In the example exhibited in FIG. 5, the environmental condition detector embodiment is a smoke detector using voice as an environmental condition location identifier only. The recorded voice message 100 is inserted into the defined silence periods of the prescribed audible tonal pattern alarm 95 consistent with conventional smoke detector alarms.

Figure 6:
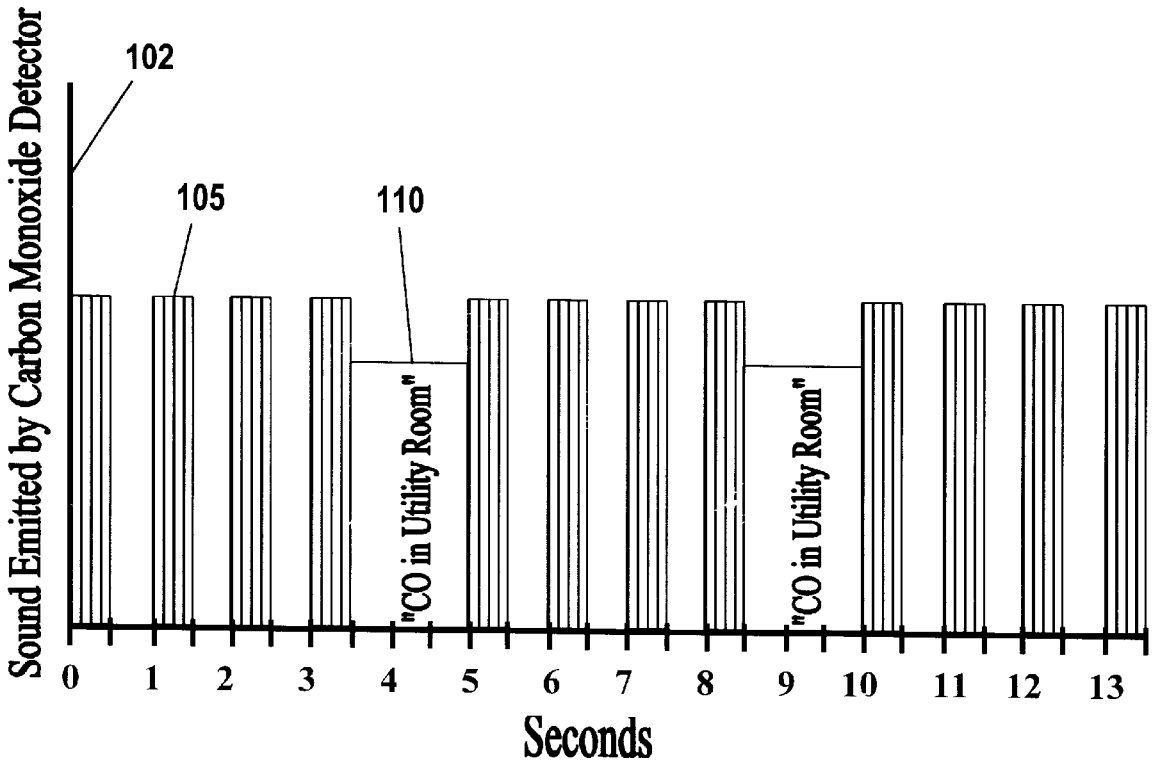
FIG. 6 shows an example audible tonal pattern alarm and recorded voice message combination used for the Environmental Condition Detector with Alarm and Voice Identifier configured as a carbon monoxide detector and using a recorded voice message as an environmental condition type identifier and location identifier according to the invention.

Shown in FIG. 6 is an example alarm timing plot of sound emitted 102 by an environmental condition detector using an audible tonal pattern alarm 105 and a recorded voice message 110 to convey the specific type of environmental condition detected and the location of the environmental condition detector sensing the environmental condition. In the example exhibited in FIG. 6 the environmental condition detector embodiment is a carbon monoxide detector using voice as both an environmental condition type identifier and location identifier. The recorded voice message 110 is inserted into the defined silence periods of the prescribed audible tonal pattern alarm 105 consistent with conventional carbon monoxide alarms. The example tonal pattern alarms and recorded voice messages are illustrative and not intended to provide an exhaustive exhibit of all possible tonal alarm patterns and recorded voice messages.

Figure 7:
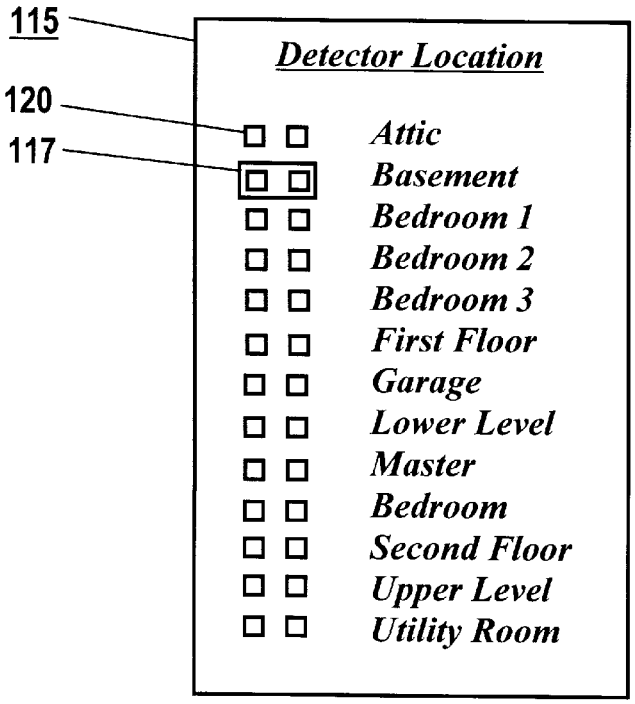
FIG. 7 shows one method for the user to select the installation location coding of the Environmental Condition Detector with Alarm and Voice Identifier according to the invention.

Shown in FIG. 7 is a selectable coding apparatus 115 for the user to select one of the pre-defined locations of the Environmental Condition Detector with Alarm and Voice Identifier embodiment when and where it is installed in a dwelling. Selectable coding means such as a jumper 117 on DIP header pins 120 or DIP switches (not shown) are simple methods to define the installation location of a detector embodiment. Typical dwelling locations are shown in FIG. 7 and are not intended to exhibit an exhaustive list.

The various preferred embodiments described above are merely descriptive of the present invention and are in no way intended to limit the scope of the invention. Modifications of the present invention will become obvious to those skilled in the art in light of the detailed description above, and such modifications are intended to fall within the scope of the appended claims.

What is claimed is:

1. An environmental condition sensor using pre-recorded voice messages to indicate the specific type of environmental condition detected in a dwelling comprising:

(a) at least one sensor for detecting the presence of an environmental condition in the dwelling, wherein said sensor comprises a type selected from the group including a smoke detector type, a carbon monoxide detector type, a natural gas detector type, a propane detector type, and any multiple combination of these environmental condition detector types;

(b) an electronic storage device for storing at least one user unalterable pre-recorded voice message which represents the type of the environmental condition;

(c) a selecting device for a user to select a language type for the user unalterable pre-recorded voice message;

(d) an electronic circuit coupled to the sensor, and the devices for activation of an alarm having user unalterable, prescribed groups of pulsating audible tonal patterns for the duration of the detection of said environmental condition, wherein groups of patterns are spaced apart by predetermined silent periods, wherein said electronic circuit repeatedly emits a selected language type of said pre-recorded user unalterable voice message which represents the specific type of detected environmental condition for the duration of the detection of said environmental condition such that said voice message is repeatedly emitted during at least some of said silent periods;

(e) a power source input coupled to said circuit and selected from a group including a battery input, an AC input, and an AC with a battery back-up input; and (f) a housing which carries said sensor, said electronic circuit, said electronic storage device, said selecting device, and said power source input.

2. An environmental condition sensor using pre-recorded voice messages to indicate the specific location of environmental condition detected in a dwelling comprising:

(a) at least one sensor for detecting the presence of an environmental condition in the dwelling, wherein said sensor comprises a type selected from the group including a smoke detector type, a carbon monoxide detector type, a natural gas detector type, a propane detector type, and any multiple combination of these environmental condition detector types;

(b) an electronic storage device for storing user unalterable pre-recorded voice messages; wherein each message represents a different location of detected environmental condition;

(c) a selecting device for a user to select one of the pre-recorded voice messages to represent the location of said environment sensor;

(d) an electronic circuit coupled to said at least one sensor, and the devices for activation of an alarm having user unalterable prescribed groups of pulsating audible tonal patterns for the duration of the detection of said environment condition, wherein groups of patterns are spaced apart by predetermined silent periods, wherein said electronic circuit repeatedly emits selected pre-recorded user unalterable voice messages that verbally describe the location of the detected environmental condition for the duration of detection thereof such that said selected pre-recorded voice message is repeatedly emitted during at least some of said silent periods;

(e) a power source input, coupled to said circuit, selected from a group which includes a battery input, an AC input, and an AC with a battery back-up input; and (f) a housing which carries said sensor, said electronic circuit, said electronic storage device, said selecting device, and said power input.

3. The environmental condition sensor of claim 2 wherein said electronic circuit to play said pre-recorded voice messages has further means to provide for the selection of language type presentation of said pre-recorded voice messages.

4. An environmental condition sensor using pre-recorded voice messages to indicate the specific type and location of environmental condition detected in a dwelling comprising:

(a) at least one sensor for detecting the presence of an environmental condition in the dwelling, wherein said sensor comprises a type selected from the group including a smoke detector type, a carbon monoxide detector type, a natural gas detector type, a propane detector type, and any multiple combination of these environmental condition detector types;

(b) an electronic storage device for storing user unalterable pre-recorded voice messages, wherein said messages include different locations and types of detected environmental conditions;

(c) a selecting device for a user to select one of the pre-recorded voice messages to represent the location of said environmental sensor;

(d) an electronic circuit, coupled to said at least one sensor and the devices for activation of an alarm having user unalterable prescribed groups of pulsating audible tonal patterns for the duration of the detection of said environmental condition, wherein groups of patterns are spaced apart by predetermined silent periods, wherein said electronic circuit repeatedly emits voice messages representing the type of detected condition during at least some of said silent periods and then repeatedly emits other voice messages representing the location of the sensor during the same silent periods; wherein said prescribed groups of pulsating audible tonal patterns are interleaved with said pre-recorded voice messages;

(e) a power source input coupled to said circuit and selected from a group including a battery input, an AC input, and an AC with a battery back-up input; and (f) a housing which carries said sensor, said electronic circuit, said electronic storage device, said selecting device, and said power source input.

5. The environmental condition sensor of claim 4 wherein said electronic circuit to play said pre-recorded voice messages has further means to provide for the selection of language type presentation of said pre-recorded voice messages.

6. An environmental condition detection system using pre-recorded voice messages to indicate the specific type of an environmental condition detected in a dwelling comprising;

(a) at least two environmental condition detectors, each detector comprising at least one sensor for detecting the presence of an environmental condition in said dwelling, wherein said sensor comprises a type selected from the group including a smoke detector type, a carbon monoxide detector type, a natural gas detector type, a propane detector type, and any multiple combination of these environmental condition detector types;

(b) each environmental condition detector comprising a selecting device for a user to select a language type for a user unalterable pre-recorded voice message;

(c) each environmental condition detector comprising an electronic circuit, coupled to a respective device, for activation of an audible alarm having user unalterable prescribed groups of pulsating audible tonal patterns for the duration of the detection of said environmental condition, wherein groups of patterns are spaced apart by predetermined silent periods; said electronic circuit comprising an electronic device for storing pre-recorded voice messages representative of the type of environmental condition;

(d) wherein each said electronic circuit repeatedly emits a selected language type of said pre-recorded voice messages that verbally describe the type of said detected environmental condition for the duration of the detection thereof such that said pre-recorded voice messages are emitted during at least some of said silent periods;

(e) each environmental condition detector comprising direct hardwired interconnection terminals for electrically linking a plurality of like environmental condition detectors such that the detection of said environmental condition by one detector causes all other hardwired interconnected detectors to emit the same tonal pattern alarm and same pre-recorded voice messages emitted by said environmental condition detector sensing said environmental condition;

(f) each environmental condition detector comprising a power source input, coupled to the circuit selected from a group including of a battery input, an AC input, and an AC with a battery back-up power input; and (g) each environmental condition detector comprising a housing for carrying its respective sensor, electronic circuit, electronic storage device, selecting device, and power source input.

7. An environmental condition detection system using pre-recorded voice messages to indicate the specific location of an environmental condition detected in a dwelling comprising:

(a) at least two environmental condition detectors, each detector comprising at least one sensor for detecting the presence of an environmental condition in the dwelling, wherein said sensor comprises a type selected from the group including a smoke detector type, a carbon monoxide detector type, a natural gas detector type, a propane detector type, and any multiple combination of these environmental condition detector types;

(b) each environmental condition detector comprising a selecting device for a user to select one of a plurality of user unalterable pre-recorded voice messages, each represents a location for said environmental sensor;

(c) each environmental condition detector comprising an electronic circuit, coupled to a respective sensor and a respective device for activation of an audible alarm having user unalterable prescribed groups of pulsating audible tonal patterns for the duration of the detection of said environmental condition, wherein groups of patterns are spaced apart by predetermined silent periods, said electronic circuit comprising an electronic device for storing pre-recorded voice messages representative of different locations of the environmental condition sensor;

(d) wherein each said electronic circuit repeatedly emits the selected one of the pre-recorded voice messages that verbally describe the location of said environmental condition for the duration of the detection thereof such that said pre-recorded voice messages are emitted during at least some of said silent periods;

(e) each environmental condition detector comprising direct hardwired interconnection terminals for electrically linking a plurality of like environmental condition detectors such that the detection of said environmental condition by one detector causes all other hardwired interconnected detectors to emit the same tonal pattern alarm and same pre-recorded voice messages emitted by said environmental condition detector sensing said environmental condition;

(f) each environmental condition detector comprising a power source input coupled to the circuit, selected from a group including a battery input, an AC input, and an AC with a battery back-up power supply input; and (g) each environmental condition detector comprising a housing for carrying its respective sensor, electronic circuit, electronic storage device, selecting device, and power source input.

8. The environmental condition detection system of claim 7 wherein said electronic circuit to play said pre-recorded voice messages has further means to provide for the selection of language type presentation of said pre-recorded voice messages.

9. A self-contained environmental condition detector comprising:

at least one ambient condition sensor wherein said at least one sensor comprises a type selected from a group including a smoke sensor type, a carbon monoxide sensor type, a natural gas sensor type, a propane sensor type, and any multiple combination of these environmental condition sensor types;

a control element coupled to said at least one sensor, wherein the control element includes circuitry for detecting a first alarm condition;

a selecting element, coupled to the control element, for a user to select a language type for a user unalterable pre-recorded voice message;

an alarm indicating audible output device coupled to the control element wherein the control element, in response to the first alarm condition, drives the output device to emit at least one set of alarm patterns, wherein each pattern has a preset number of pulsating alarm tones, each alarm pattern is spaced apart by a first silent time interval from the next pattern and wherein pulsating tones in a pattern are spaced apart from one another by a second time interval;

voice circuit for storing at least a first, user unalterable, predetermined verbal, alarm-type output message, coupled to the control element and associated with said at least one sensor, wherein the circuit, in response to the presence of a first detected alarm condition, injects the verbal, alarm-type output message in the selected language type repetitively, only into the first intervals; and a housing for carrying said sensor, said control element, said alarm device, said voice circuit.

10. A detector comprising:

a housing;

a fire sensor and a gas sensor, both carried by the housing;

a control element coupled to the sensors wherein the element includes circuitry for detecting a fire alarm and for detecting a gas alarm;

an alarm indicating audible output device coupled to the control element wherein the control element in response to a fire alarm drives the output device to repetitively emit interrupted groups of fire alarm tones wherein the members of the groups are spaced apart from one another by a first time interval and each member has a width corresponding to the first time interval and wherein groups are spaced apart by silent, longer second time intervals, and wherein the control circuit in response to a gas alarm drives the output device to repetitively emit different, interrupted groups of gas alarm tones wherein the members of the groups are spaced apart from one another by a third time interval and wherein groups are spaced apart by silent, longer, fourth time intervals;

a voice output circuit coupled to the control element, wherein the voice output circuit includes storage for at least a word indicative of a fire alarm and storage for at least a phrase indicative of a gas alarm, wherein in response to a fire alarm the output circuit injects the stored fire alarm indicating word into only the second time intervals between groups of fire alarm tones and wherein in response to a gas alarm the output circuit injects the stored gas alarm indicating phrase into only the fourth time intervals;

wherein the tonal patterns and output word and phrase are predefined and not user alterable; and wherein the voice output circuit includes an audio output transducer.

11. A method for providing environmental condition detection for a dwelling comprising:

(a) providing an environmental condition detection system to a dwelling, said dwelling comprising one or more distinctive regions selected from the group consisting of rooms, floor levels, areas, closets, attics, basements, passages, hallways, stairways, crawlspaces, garages, and any multiple combination thereof, (b) setting a selectable coding means to define the detector installation location, within said dwelling, for each detector comprising said environmental condition detection system to cause the detector sensing an environmental condition to play a user unalterable pre-recorded voice message, which verbally describes said detector installation location of said detector sensing an environmental condition, during the periods of silence in a prescribed audible tonal pattern alarm emitted by said detector sensing an environmental condition simultaneously with said pre-recorded voice message for the duration of said environmental condition, (c) interconnecting a minimum of two environmental condition detectors forming said environmental condition detection system such that the tonal pattern alarm and pre-recorded voice messages emitted by one environmental condition detector sensing an environmental condition causes all other interconnected detectors to emit the same tonal pattern alarm and pre-recorded voice message as those emitted by said environmental condition detector sensing said environmental condition.

12. The method of claim 11 wherein said method comprises playing a pre-recorded voice message that verbally describes the type of environmental condition detected for the duration of the detection of the said environmental condition such that said pre-recorded voice message is emitted during periods of silence in said prescribed audible tonal pattern alarm emitted simultaneously.

13. The method of claim 11 wherein said method comprises providing an environmental condition detector type selected from the group consisting of a smoke detector type, a carbon monoxide detector type, a natural gas detector type, a propane detector type, and any multiple combination of these environmental condition detector types.

14. A self-contained ambient condition detector comprising:

first and second, different, ambient condition sensors;

control electronics coupled to the sensors wherein the electronics emits at least two, different, unalterable pre-stored alarm indicating tonal, output patterns wherein each pattern includes predetermined silent intervals and each is associated with a respective one of the sensors;

voice output circuitry, coupled to the electronics, wherein the voice circuitry includes at least two pre-stored, user unalterable, verbal alarm output messages wherein each of the pre-stored messages is associated with a respective one of the tonal output patterns and verbalizes the respective alarm type and wherein the control electronics, in response to a detected alarm condition, outputs an audio representation of a respective one of the tonal patterns and an interleaved respective verbal alarm type message in a respective silent interval; and a common housing for the sensors, the electronics and the output circuitry.

15. A detector as in claim 14 wherein one of the sensors is a smoke sensor and the respective, prestored verbal message is a fire alarm to reinforce the respective tonal output pattern indicative of a fire alarm.

16. A detector as in claim 15 wherein the other sensor is a carbon monoxide sensor and the respective pre-stored verbal message is a carbon monoxide alarm to reinforce the respective tonal output pattern, indicative of a carbon monoxide alarm.

17. A detector as in claim 16 wherein at least one tonal output pattern defines groups of three substantially identical output tones with constant intragroup spacing of a first amount and constant intergroup spacing of a second amount wherein another tonal output pattern defines groups of four substantially identical output tones with constant intragroup spacing of a third amount and constant intergroup spacing of a fourth amount.

18. A detector as in claim 17 wherein each tone of one tonal pattern has a duration on the order of 0.5 seconds.

19. A detector as in claim 14 wherein each tonal output pattern defines groups of substantially identical output tones with constant intragroup spacing of a first amount and constant intergroup spacing of a second amount wherein the second amount is at least two times than the first amount.

20. A detector as in claim 19 wherein one tonal pattern has an intragroup spacing on the order of 0.5 seconds and an intergroup spacing on the order of 1.5 seconds.

21. A self-contained ambient condition detector comprising:

a fire sensor and a gas sensor;

control electronics coupled to the sensors wherein the electronics emits at least first and second, different, unalterable pre-stored alarm indicating tonal, output patterns wherein each pattern includes groups of spaced apart tones separated by longer intergroup silent intervals and wherein each output pattern is associated with a respective one of the sensors;

voice output circuitry, coupled to the electronics, wherein the voice circuitry includes at least two pre-stored, user unalterable, verbal alarm output messages wherein each of the pre-stored messages is associated with a respective one of the tonal output patterns and verbalizes the respective alarm type and wherein the control electronics, in response to a detected alarm condition, outputs an audio representation of a respective one of the tonal patterns and an interleaved respective verbal alarm type message in a respective intergroup silent interval; and a common housing for the sensors, the electronics and the output circuitry.

22. A detector as in claim 21 wherein the first tonal output pattern, associated with the fire sensor, comprises a selected number of tones in each group with intragroup tonal spacing less than 50% of the respective intergroup silent interval and wherein the second tonal output pattern, associated with the gas sensor, comprises a greater number of tones in each group than the selected number of tones.

* * * * *

UNITED STATES PATENT AND TRADEMARK OFFICE

CERTIFICATE OF CORRECTION

PATENT NO. : 6,144,310
DATED : November 7, 2000
INVENTOR(S) : Gary Jay Morris

It is certified that error appears in the above-identified patent and that said Letters Patent is hereby corrected as shown below:

Column 14,
Line 11, please insert -- greater -- after “times”.

Signed and Sealed this

Twenty-sixth Day of August, 2003

JAMES E. ROGAN
*Director of the United States Patent and Trademark Office*